US007465372B2

(12) United States Patent
Sundman et al.

(10) Patent No.: US 7,465,372 B2
(45) Date of Patent: Dec. 16, 2008

(54) METHOD FOR TREATMENT OF SPENT LIQUOR

(75) Inventors: Kari Sundman, Pirkkala (FI); Markku Raiko, Hyvinkää (FI); Mika Repka, Helsinki (FI); Jari Sutinen, Espoo (FI)

(73) Assignee: Metso Power Oy, Tampere (FI)

( * ) Notice: Subject to any disclaimer, the term of this patent is extended or adjusted under 35 U.S.C. 154(b) by 0 days.

(21) Appl. No.: 10/519,350

(22) PCT Filed: Jul. 4, 2002

(86) PCT No.: PCT/FI02/00611

§ 371 (c)(1),
(2), (4) Date: Jul. 14, 2005

(87) PCT Pub. No.: WO2004/005610

PCT Pub. Date: Jan. 15, 2004

(65) Prior Publication Data

US 2005/0284593 A1 Dec. 29, 2005

(51) Int. Cl.
*D21C 11/12* (2006.01)

(52) U.S. Cl. ..... 162/30.11; 162/30.1; 162/47

(58) Field of Classification Search ..... 162/30.11, 162/16, 30.1, 31, 32, 36, 47; 48/197 R, 199 FM
See application file for complete search history.

(56) References Cited

U.S. PATENT DOCUMENTS

| | | | | | |
|---|---|---|---|---|---|
| 3,250,591 | A | * | 5/1966 | Bergholm et al. | 423/179 |
| 3,365,268 | A | * | 1/1968 | Prahacs et al. | 423/358 |
| 3,607,619 | A | * | 9/1971 | Hess et al. | 162/30.11 |
| 3,639,111 | A | * | 2/1972 | Brink et al. | 48/111 |
| 3,762,989 | A | * | 10/1973 | Timpe | 162/30.11 |
| 4,135,968 | A | * | 1/1979 | Dehaas | 162/30.1 |
| 4,497,637 | A | * | 2/1985 | Purdy et al. | 48/111 |
| 4,511,433 | A | * | 4/1985 | Tournier et al. | 162/16 |
| 4,682,985 | A | * | 7/1987 | Kohl | 48/197 R |
| 4,808,264 | A | | 2/1989 | Kignell | 162/30.1 |
| 4,872,950 | A | * | 10/1989 | Andersson et al. | 162/15 |
| 5,174,860 | A | * | 12/1992 | van Heiningen et al. | 162/30.11 |
| 5,211,002 | A | * | 5/1993 | Ruottu | 60/780 |
| 5,284,550 | A | * | 2/1994 | Tanca et al. | 162/31 |
| 5,370,771 | A | * | 12/1994 | Nilsson | 162/30.1 |
| 5,370,772 | A | * | 12/1994 | Arpalahti et al. | 162/30.11 |
| 5,425,850 | A | * | 6/1995 | Tanca et al. | 162/31 |
| 5,507,141 | A | * | 4/1996 | Stigsson | 60/775 |
| 5,582,683 | A | * | 12/1996 | Bonsu et al. | 162/30.1 |
| 5,660,685 | A | * | 8/1997 | Nilsson | 162/16 |
| 5,711,768 | A | * | 1/1998 | Schulz | 44/552 |
| 5,738,758 | A | * | 4/1998 | van Heiningen | 162/30.11 |
| 5,752,994 | A | * | 5/1998 | Monacelli et al. | 48/111 |
| 6,027,609 | A | * | 2/2000 | Nilsson | 162/30.1 |
| 6,030,493 | A | * | 2/2000 | Nilsson | 162/30.1 |
| 6,062,547 | A | * | 5/2000 | Nilsson | 261/108 |
| 6,113,739 | A | * | 9/2000 | Nilsson | 162/30.1 |
| 6,596,908 | B1 | * | 7/2003 | Hermescec et al. | 568/749 |
| 2005/0284593 | A1 | * | 12/2005 | Sundman et al. | 162/30.11 |
| 2006/0201641 | A1 | * | 9/2006 | Harris et al. | 162/37 |

FOREIGN PATENT DOCUMENTS

| | | | |
|---|---|---|---|
| FI | 82494 | | 11/1990 |
| FI | 91290 | | 2/1994 |
| WO | 9614468 | | 5/1996 |
| WO | WO 2004005610 | A1 * | 1/2004 |

OTHER PUBLICATIONS

Gessner G. Hawley, The Condensed Chemical Dictionary, Tenth Edition, Van Nostrand Reinhold Co., 1981, p. 796.*

Magnusson. Power and Chemicals—New Possibilities for the Kraft Recovery Process. Proceedings of the 1998 International Chemical Recovery Conference, Tampa, Florida, 1998, pp. 981-982.

* cited by examiner

*Primary Examiner*—José A Fortuna
(74) *Attorney, Agent, or Firm*—WolfBlock LLP

(57) ABSTRACT

Method for treatment of spent liquor at a pulp mill, in which method at least a part of the spent liquor flow arriving from the evaporation plant is taken to a pyrolysis reactor, wherein it is pyrolysed at a temperature of 300-800° C. in order to separate evaporable compounds from the coke remaining in a solid state. The pyrolysis products, which are gases or liquids, may be used as fuel or they may be processed further. The coke resulting from the pyrolysis is burnt in a soda recovery boiler or in a gasification reactor to regenerate cooking chemicals. The method is suitable for recovery of chemicals and energy both in sulphate and sulphite processes and also in cooking methods based on organic solvents.

9 Claims, 2 Drawing Sheets

METHOD FOR TREATMENT OF SPENT LIQUOR

BACKGROUND OF THE INVENTION

The invention concerns a method for treatment of spent liquor from a pulp mill in order to recover the chemicals and energy contained in the liquor. Spent liquor in this context means black liquor and such spent liquors resulting from sulphite cooking of different kinds as well as from other pulp cooking processes, which contain cooking chemicals as well as organic substances dissolved from delignified material.

In the pulp process, the fibrous raw material is cooked in a cooking chemical solution, which in the sulphate process contains sodium sulphide and sodium hydroxide and in the sulphite process contains sulphite solutions of different kinds. During cooking organic compounds will dissolve from the wood material, and the most important of these is the lignin binding the wood fibres to each other. After cooking, the fibres are separated from the spent liquor formed by cooking chemicals and by the substances dissolved from the wood. In the sulphate process this liquor is called black liquor, whereas in sulphite methods its more general name is spent liquor. The dilute spent liquor existing after washing is evaporated to a dry matter content, which may be even 70-85% depending on the mill. Various cooking methods for separation of the fibres and based on organic solvents have also been presented. These differ from the sulphate and sulphite processes as regards their circulation of chemicals, among other things. To date the cooking methods based on organic solvents have not achieved a significant position in competition with the sulphate and sulphite methods, which are more efficient when using modem technology.

After the evaporation plant, the spent liquor is processed by burning it in controlled conditions in a spent liquor boiler, which is usually a soda recovery boiler when using sodium-based cooking solutions. The primary task of the soda recovery boiler is to bring about favourable conditions for collecting in such a form the inorganic chemicals contained in the spent liquor, that after regeneration they can once again be used in the cooking process. Another important task of the soda recovery boiler is to recover the chemical energy contained in the organic substance dissolved from the wood, which takes place as a normal steam boiler process. As the organic substance burns, heat is released from it and the heat is used for producing high-pressure steam for the production of electricity and low-pressure steam for process use. No soda recovery boiler is needed in connection with cooking based on organic solvents, but the circulation of chemicals takes place by distilling or by some other chemical method. The substance containing lignin, from which the cooking chemicals have been separated, can be burnt, for example, in an ordinary fluidised-bed boiler or in some other burning equipment.

The soda recovery boiler technology is a very conservative one. The burning device in question is one resembling the steam boiler with a structure and operation that have mainly remained the same over decades. Improving the reliability and increasing the capacity while keeping the old principles of operation have been important aspects in the development. The soda recovery boiler is usually the biggest and most expensive component in the pulp mill and its investment costs are approximately 15-25% of the total price of the mill. Since the composition of the spent liquor burnt in the soda recovery boiler entails problems to do with material technology, the values of steam produced in the soda recovery boiler are low compared with conventional power boilers, which results in a poor power-to-heat ratio from the viewpoint of electricity production.

Alternative solutions have been presented for replacing the soda recovery boiler, and of these the gasification of black liquor has come closest to commercial implementation. Patents FI 82494 and FI 91290 describe examples of methods for recovering chemicals and energy based on gasification of black liquor.

In FI Patent 82494, the black liquor is gasified in a pressurised gasification reactor at a temperature of 700-1300° C. using air or oxygen as the gasification medium, whereby the organic substance of the black liquor is converted entirely into gases.

The inorganic chemicals form a smelt consisting mainly of sodium carbonate and sodium sulphide. The heat needed by the reactions is produced by using oxygen at the early gasification reactor stage to burn the hydrogen and carbon monoxide obtained in the gasification. The gas is cooled, washed and used as fuel to generate steam and, if economically profitable, to produce electric energy.

In FI Patent 91290, the black liquor is gasified with the aid of air at a temperature of 800-1200° C., whereby the inorganic compounds are recovered in the melt phase as compounds that can be used in the cooking process and as energy of the organic compounds of the black liquor, which energy is mainly bound to the chemical compounds of the gas phase. The gases obtained in gasification and containing sodium compounds are conducted into a particle cooler and into a filter, from which the sodium dust is returned to the gasification device. The clean gas is taken to the gas turbine.

In spite of the great expectations on commercialisation of gasification, practice has shown that the energy efficiency of the gasification process is poorer than that of traditional soda recovery boilers, at least to date. Extra losses also relate to the conversion of energy. The product gas formed by the mixture of combustible and non-combustible gases has a relatively low thermal value. In addition, it is expensive to clean the product gas, and the usability of gasification plants is rather poor at the present time.

OBJECTS OF THE INVENTION

The present invention aims at a new manner of treating black liquor or other spent liquor of the pulp process in order to achieve the desired final result in an economically more sensible way than has been achieved with the traditional soda recovery boiler technology. Hereby the spent liquor is brought into such a form that it is possible to use it for making valuable biologically-based fuels and other upgraded products.

Another objective is to allow utilisation of the chemical energy content of the spent liquor in such a way that the share of electricity production can be increased in comparison with the traditional solutions.

An additional objective of the invention is a solution, which may be used when required to add to the insufficient capacity of the soda recovery boiler or to replace the soda recovery boiler altogether.

In order to achieve the objectives presented above and those emerging hereinafter, the solution according to the invention is characterised by the features described below.

BRIEF SUMMARY OF THE INVENTION

The present invention describes four ways of treating black liquor or other spent liquor, each one having in common the use of a pyrolysis process as one sub-step in the recovery of chemicals and energy. The pyrolysis is carried out as a separate unit process, that is essentially different from the gasification, which is also applied as a further treatment step in two solutions according to the invention.

Pyrolysis in this context means a thermo-chemical process, wherein the heat introduced into the process separates the evaporable components from the treated solid or liquid organic substance. Chemical reactions take place primarily only as internal reactions of the treated substance and/or as reactions between the released gases and the treated substance and/or as reactions between gases released from the treated substance. External components, such as gases leaked into the reactor vessel, will cause secondary reactions of minor significance only. In this case, distilling can be regarded as a special case of pyrolysis.

Gasification means turning the starting material into a gaseous state in a chemical process with the aid of heat and an external gaseous component or components aside from the starting material. The most generally used gasification components are air, $O_2$, $CO_2$ and $H_2O$. As regards black liquor a method is also known, which is based on the reaction between $Na_2CO_3$ and $H_2S$ and which is described in the publication Magnusson, Hans, "*Power and Chemicals—New Possibilities for the Kraft Recovery Process*", Proceedings of the 1998 International Chemical Recovery Conference, Tampa, Fla., 1998, p. 981-982. This method too is suitable for use for gasification of coke resulting from pyrolysis of spent liquor and for regeneration of salts in the coke in the method according to the invention. No gasification components containing free or bound oxygen are used in this method.

Primarily the gasification thus takes place with the aid of external gas components, in which respect the gasification is chemically different from pyrolysis, which is chemical decomposition of the material brought about merely by external heat. As carried out in a gasification reactor, the gasification usually also contains a pyrolysis-like sub-process, but the final products of this process are processed and admixed with the products resulting from the other chemical sub-processes of the gasification. For this reason, the product gases of the gasification reactor are different from the product gases of the pyrolysis reactor.

In the method according to the invention, at least a part of the spent liquor arriving from the evaporation plant and concentrated to a dry-matter content of 70-85% is pyrolysed at a temperature of 300-800° C. in order to separate the volatile compounds contained in the spent liquor from the coke remaining in a solid state. The above-mentioned dry-matter content range may be regarded as a guideline, and in some cases it may be more advantageous to use some other dry-matter content. Besides the spent liquor, only heat may be supplied into the pyrolysis reactor, but no gas containing oxygen. The pyrolysis is carried out in such conditions where the sulphur and sodium contents of the black liquor will mainly remain in the coke. The distillate formed by the pyrolysis products is recovered, purified and used in suitable applications at the mill and/or it is processed and/or sold outside. The coke is taken to combustion either in a soda recovery boiler or in a gasification reactor. In either case the combustion is carried out in reducing conditions in such a way that the leftovers of cooking chemicals contained in the coke will be reduced into a form required for regeneration of the chemicals, that is, mainly into sodium sulphide and sodium carbonate. Alternatively, the gasification and reduction may be carried out by using hydrogen sulphide, whereby the sodium carbonate will react with the hydrogen sulphide forming sodium sulphide. In addition, gases will result ($H_2$, CO, $H_2O$ and $CO_2$). The heat needed for gasification may be produced e.g. by a gas or oil burner or by electricity.

In a first embodiment of the method, only a part of the spent liquor flow arriving from the evaporation plant is pyrolysed and a part is taken directly to the soda recovery boiler. The coke resulting from pyrolysis is burnt in the soda recovery boiler.

A second embodiment of the method also takes a part from the spent liquor flow arriving from the evaporation plant to the soda recovery boiler while a part is pyrolysed. The coke resulting from pyrolysis is taken to a gasification reactor, wherein a reduction of sulphur compounds and carbonates is also carried out, besides the gasification of coke.

In a third embodiment of the invention, the entire spent liquor flow arriving from the evaporation plant is taken to pyrolysis and all coke resulting from the pyrolysis is gasified, whereby there is no need for any traditional soda recovery boiler.

In a fourth embodiment of the invention, the entire spent liquor flow arriving from the evaporation plant is taken to pyrolysis. The coke resulting from pyrolysis is burnt in a fluidised-bed boiler or in some other burning equipment. Hereby burning may take place e.g. in the mill's bark boiler.

The first three embodiments of the invention are very suitable in connection with sulphate and sulphite processes, and the fourth e.g. in connection with cooking carried out with an organic solvent (ethanol, formic acid, etc.).

The pyrolysis is carried out in a separate pyrolysis reactor either as a continuous process or as a batch process. The continuous process allows a higher treatment capacity per volume unit of the reactor. Advantages of the batch process are easily implemented fractionation of the products, purity of products as the ash remains in the coke, and a high thermal value of the product gas in energy production. The pyrolysis products may be gases, such as carbon monoxide, hydrocarbons and water or pyrolysis oils or both. The products can be processed further.

Pyrolysis of the spent liquor in a continuous process is carried out within an approximate temperature range of 300-800° C., wherein the temperature and other process conditions are chosen depending on the kind of desired final products. The lower limit of the temperature range is an experimentally determined temperature, at which all volatile organic components are made to evaporate from the spent liquor, while the upper limit is a temperature, at which sodium compounds begin moving over into the product gas to a significant extent. The optimum temperature for pyrolysis is between 550 and 650° C. Hereby the release of sulphur is less than at lower temperatures and, on the other hand, alkali metals will not yet be released into the pyrolysis product. The initial temperature for the batch process is determined according to the temperature of the spent liquor supplied to the reactor, whereby it may remain considerably below 300° C. The final temperature and the heating speed may be chosen according to the desired products. Other process variables affecting the quality of the final pyrolysis products are—besides the quality of the spent liquor—for example, the residence time, the heating speed and the pressure.

The solid final product remaining after the pyrolysis of spent liquor, that is, the coke, which contains a major part of the inorganic chemicals of the liquor, is either burnt in a soda recovery boiler or it is gasified in a gasification reactor. If the liquor is black liquor and/or sodium-based spent sulphite liquor, the coke taken to gasification must contain free carbon, so that reduction of $Na_2SO_4$ to $Na_2S$ is possible. The gasification is carried out within a temperature range of 1000-1400° C., whereby it is possible to guarantee a sufficiently high temperature for carrying out reductive reactions. The gasification may be carried out at atmospheric pressure or as pressurised gasification, and oxygen, carbon dioxide, water vapour or their mixture may be used as the gasifying component. When treating black liquor or any other sodium-based spent liquor, chemical gasification with hydrogen sulphide may also be used.

From the viewpoint of a sulphate and sulphite mill, the main products of the presented process are the recovered cooking chemicals, which are taken to the normal circulation of chemicals at the mill. The pyrolysis products may be used as fuel at the mill or they may be processed further e.g. into methanol, ethanol, etc. The gases brought about in the gasification may be burnt in a boiler, in a gas power engine, in a paper impingement dryer, in a lime kiln or in other applications of a similar type.

The process is flexible, allowing various parallel and series connections. With the invention it is possible to increase the spent liquor treatment capacity at the mill and to postpone purchasing of the expensive soda recovery boiler in situations where the boiler capacity is a factor limiting production. It makes it possible to raise the value of black liquor or other spent liquor with the aid of further processing and a higher power-to-heat ratio. The power-to-heat ratio of electricity production may be increased in comparison with the traditional soda recovery boiler solution. The emissions of carbon dioxide from the pulp mill are reduced, because the use of gases and pyrolysis products at the mill makes it possible to stop using fossil fuels or at least to reduce their quantity.

In the following, the invention will be described in greater detail with reference to the figures shown in the appended drawings, but the intention is not to limit the invention strictly to the details shown in the figures.

BRIEF DESCRITPION OF THE DRAWINGS

DETAILED DESCRIPTION OF THE INVENTION

Figure 1:
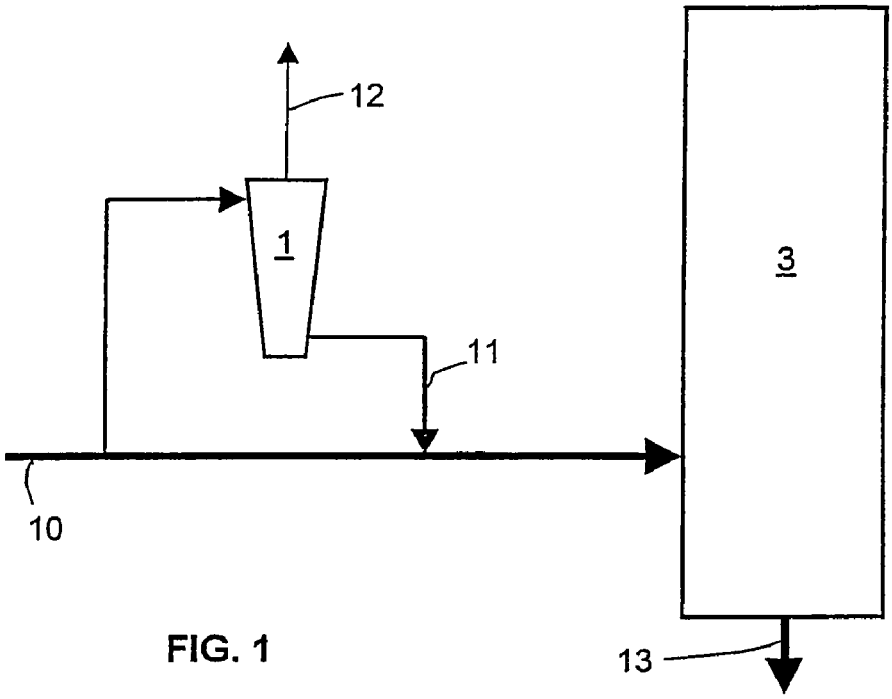
FIG. 1 is a simplified view of a first embodiment of the invention of the spent liquor treatment process according to the invention, wherein only a part of the spent liquor is pyrolysed and the resulting coke is burnt in a soda recovery boiler.

FIG. 1 shows recovery of the chemicals of black liquor based on a soda recovery boiler, wherein a part of the flow of black liquor 10 arriving from an evaporation plant is taken directly to a soda recovery boiler 3, while a part is taken to a pyrolysis reactor 1, of which there may be one or more in parallel. The pyrolysis reactor 1 may be used for a batch process or for a continuous process.

The pyrolysis is carried out in a temperature range of 300-800° C., whereby only heat is supplied into the reactor 1, and the heat makes the easily evaporating compounds in the black liquor evaporate and/or turn into gases. In batch-type pyrolysis, increasing of the temperature begins from the temperature of the spent liquor arriving from the evaporation plant, and the temperature is chosen according to the desired pyrolysis products. No oxygen or other gas is supplied to the reactor 1. The pyrolysis products 12 that have moved into the gas phase are taken away from the reactor 1 into further treatment steps, which may be washing, condensing of condensable products etc. Depending on the temperature, duration, pressure and other such factors of the pyrolysis, the final pyrolysis products 12 may be gases or liquids. The combustible gases and/or pyrolysis oil produced by pyrolysing the spent liquor are used in suitable applications at the mill and/or they are processed and/or they are sold outside.

Another final product of pyrolysis is coke 11 in a solid state and also containing, besides carbon, inorganic chemicals remaining from the cooking chemicals. In the example shown in FIG. 1, the coke 11 is taken into the soda recovery boiler 3 for burning, whereby in connection with the burning reduction of sulphur to sulphide also takes place, which is necessary for regeneration of the cooking chemicals. The coke 11 may be supplied into the soda recovery boiler 3 either admixed with the spent liquor 10 or as a separate supply. From the lower part of the soda recovery boiler 3 smelt 13 is discharged, which when the liquor is black liquor is dissolved in a manner known as such in water or in weak white liquor to form green liquor.

With the aid of pyrolysis it is possible to produce pyrolysis products of a good quality and these may be used in many applications both at the mill and outside the mill. Pyrolysis gases may be used as supporting fuel in a heat recovery boiler or as fuel in a lime kiln. They may be used for additional superheating of the soda recovery boiler or in impingement drying in a papermaking machine. They are suitable as energy sources when producing electricity by using a gas turbine. Pyrolysis oils are suitable not only as fuel but also as raw material for various further processing products, such as methanol and ethanol.

Figure 2:
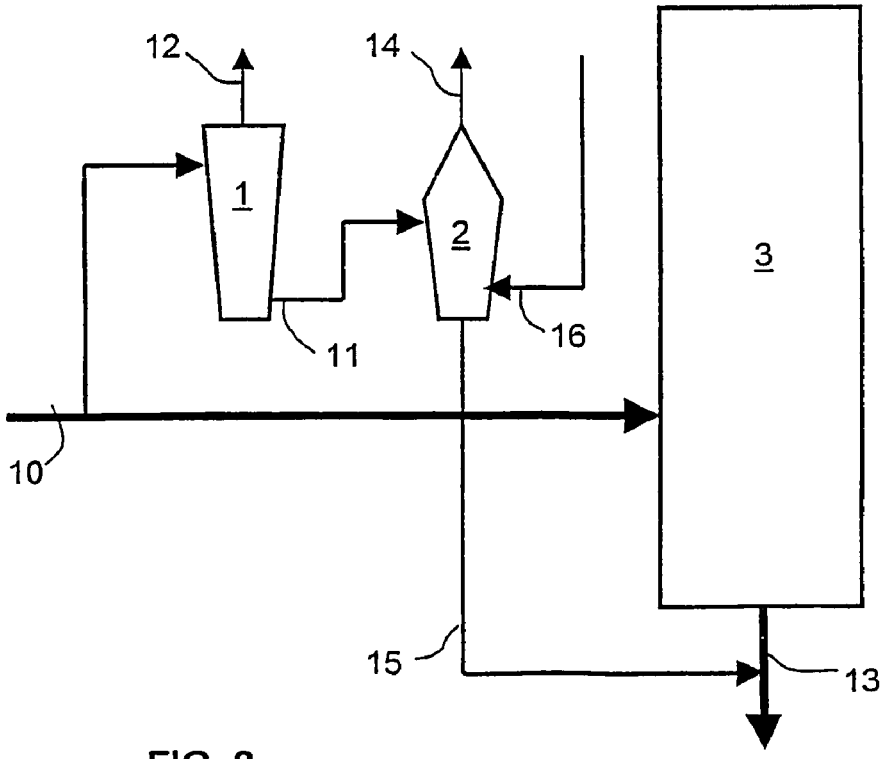
FIG. 2 is a simplified view of a second embodiment of the invention, wherein only a part of the spent liquor is pyrolysed and the resulting coke is gasified in a gasification reactor.

FIG. 2 shows a solution, which is especially suitable for situations, where the capacity of the soda recovery boiler is a limitation to an increase of the pulp mill's production. A part of the spent liquor flow 10 arriving from the evaporation plant is taken directly to the soda recovery boiler 3 and a part is taken to a pyrolysis reactor 1, wherein the evaporable compounds contained in the spent liquor are separated from the coke 11 remaining in a solid state. Differing from the solution shown in FIG. 1, the coke 11 is not taken to the soda recovery boiler 3, but it is taken to a gasification reactor 2, wherein chemical reduction of salts also takes place.

In the gasification reactor 2, heat and a gasifying component 16 are used to turn the coke 11 into product gas 14 and smelt 15, which is combined with the smelt 13 arriving from the soda recovery boiler 3. In order to bring about reduction of sulphur, a higher temperature must be used in the gasification than in pyrolysis. In gasification the usual temperature range is 1000-1400° C., and at least a part of the required heat is generated by burning coke and gases formed in the gasification.

The product gas 12 of the pyrolysis reactor 1 is separated, purified and used in suitable applications at the mill and/or it is processed and/or sold outside. Product gas 14 is also obtained in the gasification reactor 2, and this gas is purified and used at the mill in a suitable application. Pyrolysis gases are of a better quality than the gases resulting from gasification, since they contain hydrogen of the fuel and they have relatively more unburnt fractions (hydrocarbons etc.) than the gasification gases. For this reason, they are very suitable for further processing.

Figure 3:
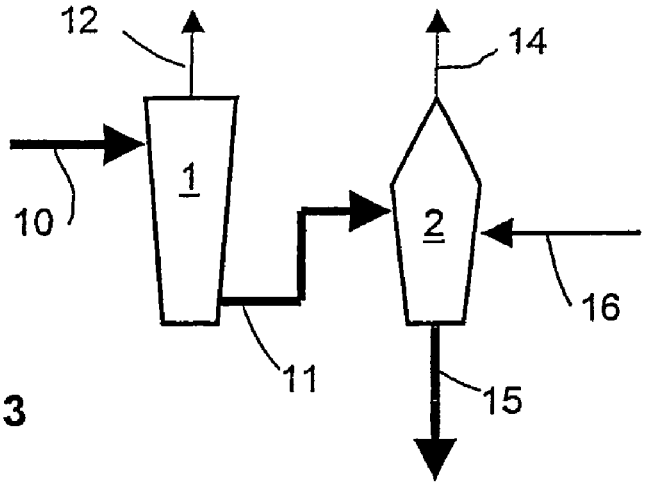
FIG. 3 is a simplified view of a third embodiment of the invention, wherein the entire flow of spent liquor is treated in pyrolysis and gasification reactors.

FIG. 3 shows an alternative solution for recovery of chemicals and energy of the spent liquor, wherein the traditional soda recovery boiler is entirely replaced by a pyrolysis reactor 1, which is followed by a gasification reactor 2. Several pyrolysis reactors 1 and gasification reactors 2 may be built in parallel, whereby the spent liquor treatment capacity can be sufficient for the entire spent liquor flow 10. The process conditions in the different reactors may also be varied in order to obtain desired products of several kinds.

The gas 14 obtained from the gasification reactor 2 and containing combustible compounds must usually be purified in order to separate solid particles. After the purification, the product gas of the gasification can be taken, for example, to a combustion boiler, a gas power engine or a gas turbine. The product gas of gasification may be used to replace natural gas both in energy production and in many pieces of process equipment in the pulp or paper mill, such as the lime kiln or the impingement dryer.

The gases produced by the pyrolysis reactor can also be used as an energy source, mainly for the same applications as gases produced by gasification. Advantages of pyrolysis gases are their higher thermal value and higher degree of purity in comparison with gases produced by gasification. In addition, the pyrolysis process allows production of pyrolysis products in a liquid state.

Figure 4:
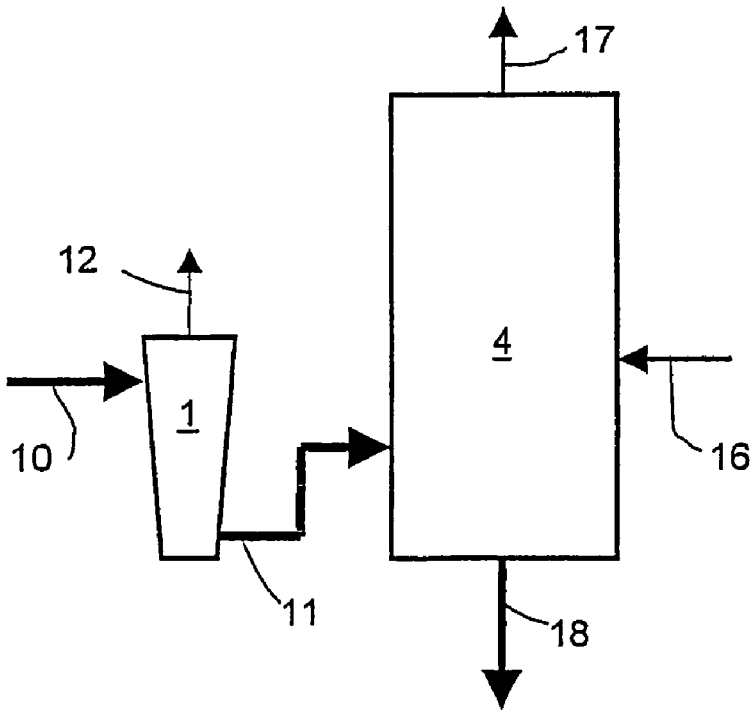
FIG. 4 is a simplified view of a fourth embodiment of the invention, wherein the entire flow of spent liquor is pyrolysed and the coke is burnt in a fluidised-bed boiler or in some other burning equipment.

FIG. 4 shows a process, which is especially suitable for treatment of spent liquors resulting in cooking processes based on organic solvents. The concentrated spent liquor 10 is taken to the pyrolysis reactor 1, wherein it is distilled with the aid of heat to obtain a separate solvent 12, which may then be used again in cooking. The coke 11 remaining in the pyrolysis is burnt, for example, in a fluidised-bed boiler or other burning equipment 4 in order to recover the energy bound therein. Combustion air 16 is supplied to the combustion boiler 4 and the combustion produces flue gases 17 and ash 18.

In the following claims are presented defining the inventive idea, within which the details of the invention may vary and differ from the above, which was presented by way of example.

The invention claimed is:

1. Method for treatment of black liquor at a pulp mill in order to recover its contents of chemicals and energy, comprising the following steps:

passing a black liquor flow (10) from an evaporation plant to a pyrolysis reactor (1), pyrolysing the black liquor in the pyrolysis reactor at a temperature of 300-800° C. in the absence of an external gas component in order to separate evaporable compounds (12) from coke (11), said coke remaining in a solid state, the evaporable compounds containing vaporized water, recovering the evaporable compounds (12) from the pyrolysis reactor, passing the coke (11) from the pyrolysis reactor to a gasification reactor (3) for gasification, gasifying the coke in the gasification reactor under such conditions that sulphur compounds contained in the coke (11) and deriving from the cooking chemicals are reduced to sodium sulphide, and recovering product gases generated by gasification in the gasification reactor.

2. Method according to claim 1, wherein only a part of the black liquor flow (10) arriving from the evaporation plant is taken to the pyrolysis reactor (1), whereas a second part of the black liquor flow (10) is taken to a soda recovery boiler (3) where it is burnt in order to recover its contents of chemicals and energy.

3. Method according to claim 1, wherein the evaporable compounds (12) separated from the black liquor in the pyrolysis reactor (1) are used at the mill as fuel in part or entirely.

4. Method according to claim 1, wherein the evaporable compounds (12) separated from the black liquor in the pyrolysis reactor (1) are processed further.

5. Method according to claim 1, wherein product gases (14) resulting from the gasification are used at the mill as fuel in part or entirely.

6. Method according to claim 1, wherein the pyrolysis reactor (1) is for a batch process, whereby increasing of the temperature may begin from the temperature of the black liquor arriving in the reactor, while the final temperature is chosen according to the desired final products.

7. Method according to claim 1, wherein the pyrolysis reactor (1) is for a continuous process.

8. Method according to claim 1, wherein the pyrolysis is carried out in such process conditions wherein the evaporable compounds (12) mainly consist of non-condensing gases.

9. Method according to claim 1, wherein the pyrolysis is carried out in such process conditions wherein the evaporable compounds (12) mainly consist of pyrolysis oil.

* * * * *